US005535925A

United States Patent [19]

Hinden et al.

[11] Patent Number: 5,535,925

[45] Date of Patent: Jul. 16, 1996

[54] CAULK-DISPENSING DEVICE

[75] Inventors: Milton Hinden, Sarasota, Fla.; John Lyons, Levitown, N.Y.

[73] Assignee: Duro Dyne Corporation, Farmingdale, N.Y.

[21] Appl. No.: 454,513

[22] Filed: May 30, 1995

[51] Int. Cl.[6] ..... B65D 88/58

[52] U.S. Cl. ..... 222/327; 222/389; 222/399

[58] Field of Search ..... 222/325–327, 222/389, 399

[56] References Cited

U.S. PATENT DOCUMENTS

| | | | |
|---|---|---|---|
| 2,818,999 | 1/1958 | Miller | 222/389 X |
| 2,838,210 | 6/1958 | Detrie et al. | 222/327 |
| 3,221,947 | 12/1965 | Penn | 222/389 X |
| 3,237,814 | 3/1966 | Collar | 222/389 X |
| 3,568,892 | 3/1971 | Burk | 222/389 X |
| 3,813,012 | 5/1974 | Laird | 222/389 X |
| 3,910,466 | 10/1975 | Collar | 222/327 |
| 4,113,151 | 9/1978 | Brown et al. | 222/389 X |
| 4,386,717 | 6/1983 | Koob | 222/389 X |
| 4,441,629 | 4/1984 | Mackal | 222/389 X |
| 4,453,651 | 6/1984 | Braithwaite et al. | 222/389 X |
| 4,570,832 | 2/1986 | Kroger | 222/389 X |
| 4,671,431 | 6/1987 | Obrist | 222/389 X |
| 5,156,305 | 10/1992 | Eyre | 222/327 |

FOREIGN PATENT DOCUMENTS

| | | | |
|---|---|---|---|
| 2216598 | 10/1973 | Germany | 222/389 |

*Primary Examiner*—Andres Kashnikow
*Assistant Examiner*—Kenneth Bomberg
*Attorney, Agent, or Firm*—Reid & Priest

[57] ABSTRACT

A caulk dispenser device for use with conventional caulking cartridges and powered by expanding refrigerant liquid is disclosed. Expanding gases are released into a chamber defined in part by a housing and in part by the caulk cartridge, the plug or piston within the cartridge forming a boundary of the chamber. Discharge of the gas directly against the piston is avoided by the interposition of a deflector surface within the housing reducing the tendency of the caulk to increase in viscosity and bond to the walls of the cartridge or to tilt relative to the cartridge. The propellant liquid-gas material incorporates an increment (e.g. 5%) of perflurocarbon or like compound liquid at ambient temperatures which minimizes the cooling effect resulting from discharge of the gas. Preferably, the device is fabricated of material having a low thermal conductivity such as polymeric material to thereby reduce the cooling effect on the canister of propellant with resultant loss of pressure.

10 Claims, 2 Drawing Sheets

CAULK-DISPENSING DEVICE

BACKGROUND AND FIELD OF THE INVENTION

The present invention is directed to a caulk dispensing device, the term "caulk", as used herein, being intended to encompass a variety of viscous materials including mastic, silicone, and related compounds.

PRIOR ART

Caulking compounds are typically packaged in tubular, cylindrical containers having a constricted dispensing nozzle at one end and a piston at the other end. Caulk is dispensed by advancing the piston toward the nozzle end of the container.

The most frequently employed dispenser for shifting the piston is comprised of a frame having means for mounting the caulk container, the frame including a plunger for engaging the rearmost surface of the piston. The plunger is connected to a push rod having longitudinally spaced ratchet teeth thereat. A lever on the frame includes a pawl which, upon manual actuation of the lever, engages a tooth of the push rod to progressively advance the push rod and plunger toward the nozzle end of the canister as the handle is actuated.

Due to the high viscosity of the caulk material substantial force must be exerted by the user with resultant rapid tiring. Also, only the most experienced users of the so-called caulk gun are able to eject a consistent stream of caulk.

In industrial installations, having access to a supply of compressed air, it is known to mount the caulk cartridge in an apparatus which advances the piston of the cartridge under pneumatic pressure. Such devices provide excellent control of the caulk bead size and are non-tiring to operate. However, the principal drawback of such devices is the requirement for a continuous supply of compressed air, a facility not normally available in the field or to the home owner.

Recognizing the desirability of pneumatically operated caulking guns we have attempted to utilize as a propulsion mechanism canisters of propulsion liquids which are gaseous at ambient and which are non-ozone depleting. While it was anticipated that adapting compressed air units to use with liquid to gas cartridges could be easily accomplished, such proved not to be the case. Initial attempts resulted in a locking of the cartridge piston, and in other instances in a discontinuous or chattering feed of caulk material resulting in a bead of discontinuous rather than smooth configuration. A further drawback observed in the attempted conversion was that the feed of caulk, once accomplished, progressively, rapidly reduced, notwithstanding the continued presence of an adequate supply of the dispensing liquid under pressure.

SUMMARY OF THE INVENTION

The present invention is predicated on our discovery that the difficulties engendered in utilizing a liquid propellant derived from complications inherent in the cooling effect developed by the expansion of the refrigerant liquid into gas. The mere substitution of liquid propellant for gas for feeding the caulk in the conventional apparatus employed in respect of compressed air feed was discovered to dramatically increase the viscosity of the caulk, and particularly in respect of dispensing from a full cartridge. The result of attempted feeds ranged from freeze up wherein no movement of the caulk was effected notwithstanding substantial pressure buildup behind the piston, to a chattering phenomenon where the caulk piston moved in a stepwise fashion with resultant inconsistent caulk bead, to canting of the caulk feed piston.

We have discovered that the efficient and effective feed of caulk packaged in conventional, tubular manner as described, can be effected by creating a dispenser device, and utilizing a dispenser liquid-gas formulation having synergistic characteristics which together provide the desired smooth caulk feed result. More particularly, we have discovered and determined that an effective liquid-gas caulk feed apparatus should include some or all of the following components.

A) The fluid stream should be impinged against a deflector which diverts the stream from direct contact with the piston whereby the congealing-freezing effect on the caulk behind the piston is minimized.

B) The liquid-gas employed as propellant of the piston should include increments of a material which is liquid at ambient whereby the cooling effects are reduced.

C) The canister containing the liquid propellant is desirably, thermally isolated such that the cooling effects are communicated to the canister to a minimal extent, since if the canister is permitted to be cooled, a significant pressure drop is observed.

It is accordingly an object of the invention to provide a caulk dispensing device adapted to accommodate a conventional caulk container of the type described which operates on the principle of propulsion powered by a liquid expanding into gaseous condition. Further object of the invention is the provision of a caulk dispenser of the type described which is lightweight and which may be used without tiring, to provide a controlled and accurate caulk bead. A further object of the invention is to provide an efficient caulk dispensing device powered by liquid to gaseous propellant. In accordance with the invention we have constructed a dispenser device utilizing a cartridge of propellant approximately one inch in diameter and four inches in length which is capable of expressing up to ten conventional caulk cartridges in actual (stop and start) use, and up to thirty caulk cartridges in continuous use.

DETAILED DESCRIPTION OF USE

Figure 3:
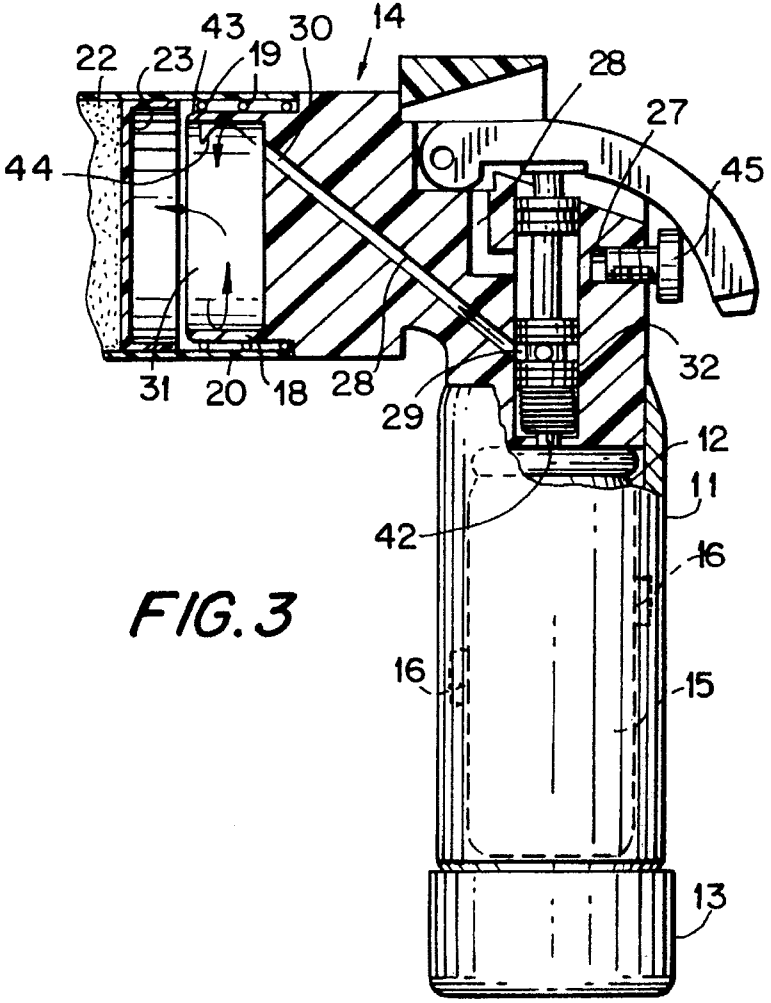
FIG. 3 is a fragmentary vertical section on a larger scale than FIG. 2, showing the position of the parts in the caulk dispensing condition.
Figure 1:
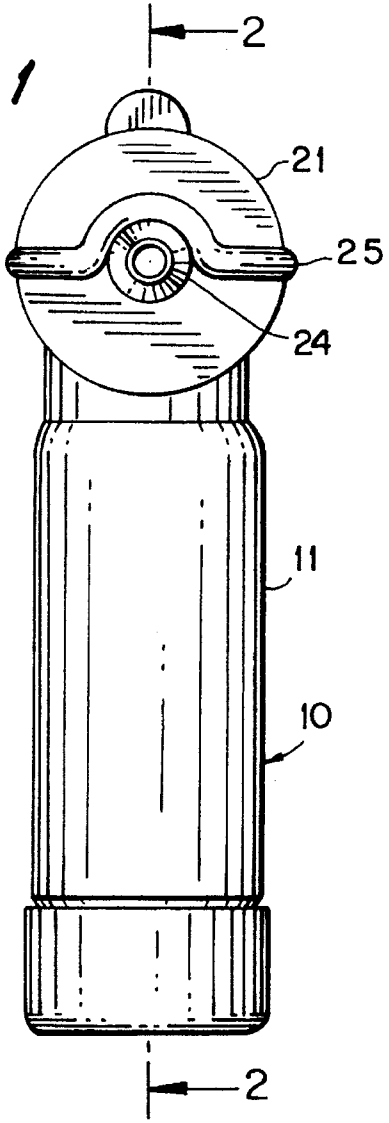
FIG. 1 is a front elevational view of a caulk dispenser with caulk cartridge mounted thereon.
Figure 2:
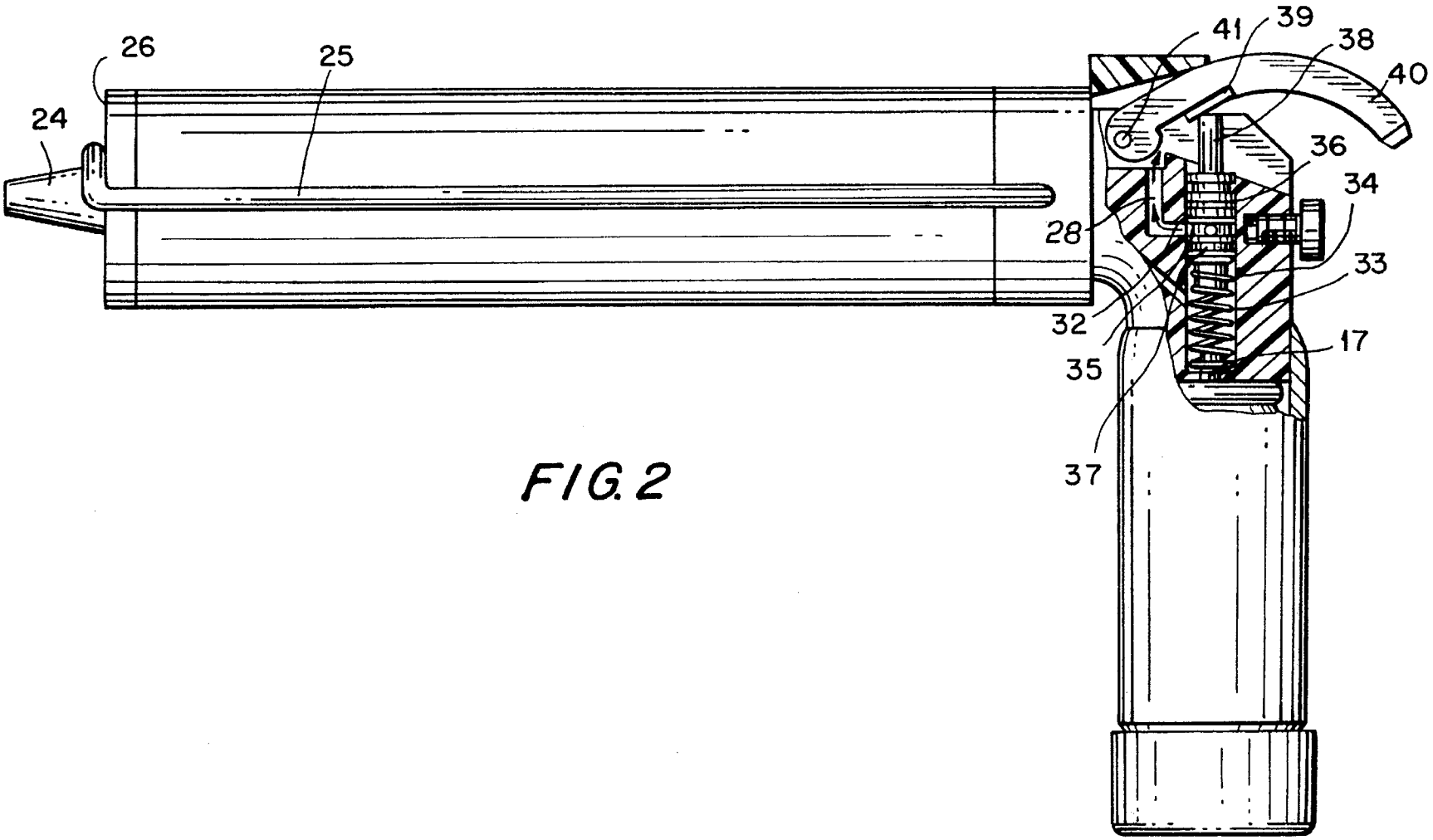
FIG. 2 is a vertical section partially broken away, taken on the line 2—2 of FIG. 1 showing the components of the device in the inactive or non-dispensing condition thereof.

Referring now to the drawings, there is shown in FIG. 1, a dispensing device 10 including a handle portion 11 within which may be mounted container 12 carrying the propellant composition. As best seen in FIGS. 2 and 3, handle 11 is in the configuration of a cylinder including a screw cap 13 which may be removed to permit loading of the canister. The handle 11 and housing 14 are preferably fabricated from a polymeric material such as nylon or delrin which is a poor thermal conductor. Desirably, the external walls 15 of the canister are maintained in spaced relation to handle 11 as by a series of spacer nodes 16 such that a space is defined between the inner walls of the handle and the external wall of the canister. The canister, which is conventional, includes at its upper end a valve stem 17. The stem, in accord with the standard canister mechanism, includes an internal spring which lifts the stem to the inactive or canister sealing condition, the valve being opened as a result of depressing the stem.

The housing 14 includes extension portion 18 carrying a series of O-rings 19 on its external periphery. The extension and O-rings are sized to provide a gas tight fit with the open end 20 of conventional caulk cartridge 21. The cartridge 21 includes a charge of caulking material 22 the open end 20 of the cartridge being closed by a piston 23 typically of plastic, which piston is shiftable axially toward the nozzle, dispensing caulking with the advance of the piston. The cartridge is maintained in mounted position on the housing 14 as by a conventional, generally U-shaped bale 25 which outwardly laps the front end 26 of the cartridge. The housing 14 includes an internal bore 27 the upper end of which is communicated to the atmosphere via discharge channel 28. The bore 27 is concentric with and encompasses valve stem 17 of the canister. A discharge passage 28 includes a first end 29 communicating with bore 27 and defining a discharge port in the bore. The upper end 30 of passage 28 extends through the housing exiting in a chamber 31 defined by the housing and the skirt or open end of the caulk container. Piston 23 forms a boundary of the chamber 31.

A pilot member 32 is mounted in bore 27 for axial movement relative thereto. The pilot 32 is shown in its depressed, dispensing condition in FIG. 3 and in its raised, inactive position in FIG. 2. The spring member 33 maintains the pilot in a normal raised condition (FIG. 2). The pilot includes an internal axial passage 34 leading to an annular discharge area 35. O-rings 36, 37 above and below the annular discharge passage 35 are in sealing relation to the bore 27.

As will be seen from the foregoing, when the pilot is in its inactive (FIG. 2) condition, discharge annulus 35 is aligned with discharge passage 28 and chamber 31 is connected to atmosphere via a path which includes passage 28, and the internal passage 34 within the pilot.

Pilot 32 includes an upwardly directed drive stem 38 which lies beneath actuator piece 39 depending from actuator lever 40 pivotally mounted as at 41 to the housing. From the foregoing it will be seen that when the lever 40 is depressed, i.e. to the position shown in FIG. 3 from the position of FIG. 1, engagement of the member 38 of the pilot with portion 39 drives the pilot downwardly to a position whereat the annular discharge port 35 is aligned with the lower end 29 of passage 28. The pilot includes an extension tailpiece 42 which in the depressed condition of FIG. 3 drives the valve stem of the canister 12 downwardly enabling expanding gases to flow through the pilot, discharge through passage 28 and be released into chamber 31. Importantly, as will be seen best from FIG. 3, the upper end 30 of passage 28 is directed towards a deflector 43 within the housing whereby the gas stream is prevented from impinging directly on the rear face of piston 23. Use of a deflector 43 which preferably includes an arcuate deflecting surface 44 is advantageous for several reasons. Firstly, deflection of the gas stream prevents direct impact against the piston, a phenomenon which would tend to tilt the piston within the cartridge. Additionally and importantly, the primary cooling effect resulting from the discharge is removed from the surface of the piston. It is this cooling effect which we have determined to be primarily responsible for the inability to directly convert from an air-powered to an expanding liquid-powered device. As noted, the freezing effect which would result from direct impingement greatly increases the viscosity of the caulk at the interface between piston and cartridge walls with resultant locking or irregular feed and the requirement for extremely high pressures to induce feed, phenomena which interfere with the flow of an even bead of caulk and which is wasteful of propellant.

Optionally and preferably, the device is provided with an adjustment screw 45 which may be threaded into or out of housing 14 providing a stop against the undersurface of the dispenser lever, enabling a degree of adjustment of the feed of the propellant and consequently the speed with which the piston is driven, hence the thickness of the bead of caulk.

We have determined that by optimizing the propellant composition, superior results may be obtained. Initially, the selected propellant was a halogenated hydrocarbon sold by DuPont Chemicals under the trademark DYMEL134A. Formula of this propellant is $CH_2FCF_3$. It was noted that the use of this propellant nonetheless entailed some continuing degree of freeze effect. We have subsequently discovered that the addition of an amount of perflurocarbon which is liquid at ambient to the DYMEL greatly reduces the freezing effect. A suitable perflurocarbon compound is available from Minnesota Milling and Manufacturing Corporation of St. Paul Minn. and has the formula of $C_5F_{11}NO$, the material being identified by the manufacturer as PF-5052.

It should be understood that the identity of propellant and fluorocarbon compositions are set forth by way of example and not by way of limitation constituting the best mode of composition now known to the inventors hereof. A preferred proportion incorporates approximately 5% of the perflurocarbon with the DYMEL propellant. It is anticipated that other combinations of propellant liquid-gas and perflurocarbons or equivalents may readily be substituted for the preferred formulation disclosed above.

From the foregoing it will be seen that the device of the invention provides an easy to use and efficient means for dispensing caulk and equivalent viscous materials. By simply varying the speed of discharge of the propellant, a controlled and continuous bead size is readily obtainable by even an inexperienced user.

It is anticipated that skilled workers in the art familiarized with the instant disclosure may readily devise variations in details of construction and formulation, without departing from the spirit of the instant invention. Accordingly, the invention hereof is to be broadly construed within the scope of the appended claims.

We claim:

1. We claim a dispenser device for use in connection with caulk cartridges of the type which include an elongate caulk-filled tubular container having a dispensing nozzle at one end, the other end of said container being open and a piston means disposed adjacent to said other end and shiftable toward said one end for extruding caulk through said nozzle, comprising in combination:

a housing having a tubular portion dimensioned to sealingly receive said open end, said housing and container defining a sealed chamber bounded by said piston, canister means adapted to be mounted in said housing containing a supply of liquid gaseous at ambient, a discharge port in said housing, valve means for selectively coupling and uncoupling said supply to said port, a passage in said housing having a first end opening to said port and a second end opening into said chamber, a deflector surface formed on said housing within said chamber, said second end of said passage being disposed in proximate spaced relation to and directed toward said deflector surface, said deflector surface being oriented relative to said second end of said passage at an angle such that the fluid emerging from said second end is directed away from said piston, and control means on said housing for selectively activating said valve means between said coupling and uncoupling conditions.

2. We claim a dispenser in accordance with claim 1 wherein said deflector surface is arcuate and arrayed relative to said second end of said passage such that fluid emerging from said second end is deflected generally perpendicular to the longitudinal axis of said container.

3. We claim a dispenser in accordance with claim 1 and including a handle portion encompassing said canister, said handle portion and housing comprising polymeric material of low thermal conductivity.

4. We claim a dispenser in accordance with claim 3 and including spacer means within said handle for engaging said container and supporting the same in spaced relation to said handle.

5. We claim, a dispenser device for use in connection with caulk cartridges of the type which include an elongate caulk-filled tubular container having a dispensing nozzle at one end, the other end of said container being open and a piston means disposed adjacent to said other end and shiftable toward said one end for extruding caulk through said nozzle, comprising in combination:

a housing having a tubular portion dimensioned to sealingly receive said open end, said housing and container defining a sealed chamber bounded by said piston, canister means adapted to be mounted in said housing containing a supply of liquid gaseous at ambient, said liquid comprising a blend of refrigerant and at least about five percent of a material which is liquid at ambient, a passage in said housing having a first end and a second end, said second end opening into said chamber, valve means shiftable between first and second positions respectively coupling and uncoupling said first end of said passage with said supply, a deflector surface formed on said housing within said chamber, said second end of said passage being disposed in proximate spaced relation to and directed toward said deflector surface whereby fluid emerging from said second end impinges against said surface, and control means on said housing for selectively shifting said valve means between said first and second positions.

6. We claim a dispenser in accordance with claim 5 wherein said refrigerant comprises tetrafluoroethane and said material comprises a perflurocarbon.

7. We claim, a dispenser device for use in connection with caulk cartridges of the type which include an elongate caulk-filled tubular container having a dispensing nozzle at one end, the other end of said container being open, and a piston means disposed adjacent to said other end and shiftable toward said one end for extruding caulk through said nozzle, comprising in combination:

a housing having a tubular extension portion dimensioned to sealingly receive said open end of said container, said housing defining with said container a chamber bounded by said piston, a canister adapted to be mounted within said housing, said canister containing a supply of refrigerant liquid gaseous at ambient, a passage in said housing having a first end and a second end, said second end opening to said chamber, valve means shiftable between first and second positions respectively coupling and uncoupling said first end of said passage with said supply, control means on said housing for shifting said valve means between said first and second positions, said supply of said canister including at least about five percent of a material which is liquid at ambient.

8. We claim a dispenser in accordance with claim 7 wherein said material comprises a perflurocarbon.

9. We claim a dispenser in accordance with claim 7 and including a deflector surface on said housing within said chamber said second end of said passage being in proximate spaced relation to and directed toward said deflector surface whereby fluid emerging from said second end impinges against said deflector surface.

10. We claim a dispenser in accordance with claim 7 wherein said deflector surface is oriented such that fluid emerging from said second end is directed away from said piston.

* * * * *